US006308860B2

(12) United States Patent
Eagle

(10) Patent No.: US 6,308,860 B2
(45) Date of Patent: Oct. 30, 2001

(54) APPARATUS FOR DISPENSING TABLETS AND FOOD PRODUCTS

(76) Inventor: Jeffrey C. Eagle, 242 1/4 N Van Ness Ave., Los Angeles, CA (US) 90004

( * ) Notice: Subject to any disclaimer, the term of this patent is extended or adjusted under 35 U.S.C. 154(b) by 0 days.

(21) Appl. No.: 09/049,208

(22) Filed: Mar. 27, 1998

(51) Int. Cl.[7] ..... B65G 59/00

(52) U.S. Cl. ..... 221/131; 221/266; 221/287; 221/283; 222/368; 222/132

(58) Field of Search ..... 221/131, 241, 221/265, 266, 282, 283, 287; 222/368, 354, 355, 568, 567, 545, 346, 562; 141/322

(56) References Cited

U.S. PATENT DOCUMENTS

| | | | | |
|---|---|---|---|---|
| D. 322,905 | | 1/1992 | Decker . | |
| D. 340,603 | | 10/1993 | Ellison . | |
| 1,560,184 | * | 11/1925 | McLean et al. | 222/368 |
| 2,401,684 | * | 6/1946 | Gumilar | 222/368 |
| 3,276,636 | * | 10/1966 | Johnson | 221/266 |
| 3,318,491 | * | 5/1967 | Williamson | 221/266 |
| 3,422,998 | * | 1/1969 | Murray | 222/567 |
| 3,491,924 | * | 1/1970 | Bloomfield et al. | 222/567 |
| 3,735,899 | * | 5/1973 | Rollinson | 222/368 |
| 3,809,300 | * | 5/1974 | Russell | 222/562 |
| 3,966,099 | * | 6/1976 | Sanford et al. | 222/567 |
| 4,162,751 | * | 7/1979 | Hetland et al. | 222/368 |
| 4,298,138 | * | 11/1981 | Oden | 221/266 |
| 4,562,941 | | 1/1986 | Sanflippo . | |
| 4,638,923 | * | 1/1987 | Mines | 221/266 |
| 5,110,008 | | 5/1992 | Moulding, Jr. et al. . | |
| 5,139,173 | | 8/1992 | Evinger . | |
| 5,405,047 | | 4/1995 | Hansen . | |
| 5,899,246 | * | 5/1999 | Cummins et al. | 141/332 |

FOREIGN PATENT DOCUMENTS

| | | | | |
|---|---|---|---|---|
| 1171839 | * | 1/1959 | (FR) | 221/266 |

* cited by examiner

*Primary Examiner*—H. Grant Skaggs
(74) *Attorney, Agent, or Firm*—Hunton & Williams

(57) ABSTRACT

A dispensing device for a container comprises a housing having an open top portion and a bottom portion. The top portion of the housing is attached or permanently affixed to a container opening. An adjustable opening is disposed at the bottom of the housing may be adjusted to permit one of the contents of the container to pass from the housing.

8 Claims, 20 Drawing Sheets

APPARATUS FOR DISPENSING TABLETS AND FOOD PRODUCTS

FIELD OF THE INVENTION

This invention relates to dispensing of products and particularly to dispensing of consumable products such as pills, and other fine food products.

BACKGROUND OF THE INVENTION

Containers come in all shapes and sizes and with all types of caps, tops, and other openings from which the contents are to be dispensed. As the complexity of these containers increases, so does the frustration many experience in attempting to gain access to the contents of those containers.

This frustration is particularly acute for those who have below-average manual dexterity such as the elderly or the physically disabled. Many of those individuals also take a number of different medications daily. Each medication is usually in a different sized or shaped container and many of those containers have different tops. Furthermore, many of these persons take vitamins or other tablet-shaped food supplements. Accordingly, these persons must manage a large number of different containers.

SUMMARY OF THE INVENTION

It is an object of the present invention to overcome these and other drawbacks with other containers and dispensing systems.

Specifically, it is an object of the present invention to provide a dispensing mechanism which allows for easy delivery of specific amounts of a food product or single unites of tablet-type products.

It is further an object of the present invention to provide a dispensing device which is attachable to many different sizes and shapes of containers in which food or tablets may be stored. Further, it is an object of the present invention to provide a dispensing device which dispenses multiple sizes of food particles or tablets.

It is another object of the present invention to provide a dispensing system providing easy delivery of tablets and/or food products from a plurality of containers.

According to these and other objects of the present invention, a dispensing mechanism for a container is provided. The dispensing mechanism comprises a housing having an open top portion and a bottom portion. The top portion of the housing is attached to a container opening. An adjustable opening is disposed at the bottom of the housing and may be adjusted to permit one of the contents of the container to pass from the housing.

According to another embodiment of the present invention, a dispensing system is provided. The dispensing system comprises one or more containers and one or more dispensing mechanisms. Each dispensing mechanism comprises a housing having an open top portion and a bottom portion. The dispensing mechanism may be as described above. Additionally, one or more holding assemblies for supporting at least one container and at least one dispensing mechanism may be provided. Each holding assembly may comprise a base portion and one or more supporting portions, connected to the base portion, for receiving and supporting at least one container.

One advantage of the present invention is the ability to dispense tablets or other smaller container contents easily without requiring the user to remove and replace a lid each time. Additionally, the dispensing mechanism of the present invention may comprise an attachment mechanism that adapts to different size containers, permitting a single dispensing mechanism to be used with a wide variety of containers and therefore reducing the number of sizes required to be manufactured.

Other objects and advantages of the present invention will be readily apparent to one of ordinary skill in the art upon reviewing the present disclosure.

BRIEF DESCRIPTION OF THE DRAWINGS

FIG. 2(*b*) depicts an overhead view of a portion of the dispensing mechanism of FIG. 2.

FIG. 4(*d*) depicts a dispensing device according to another embodiment of the present invention.

FIGS. 4(*e*)–(*g*) depict an attachment mechanism according to another embodiment of the present invention.

FIGS. 12(*b*) and (*c*) depict a support structure according to another embodiment of the present invention.

FIGS. 20(*d*)–(*e*) depict a portion of a dispensing mechanism according to an embodiment of the present invention.

DETAILED DESCRIPTION OF THE PREFERRED EMBODIMENTS

Figure 1A:
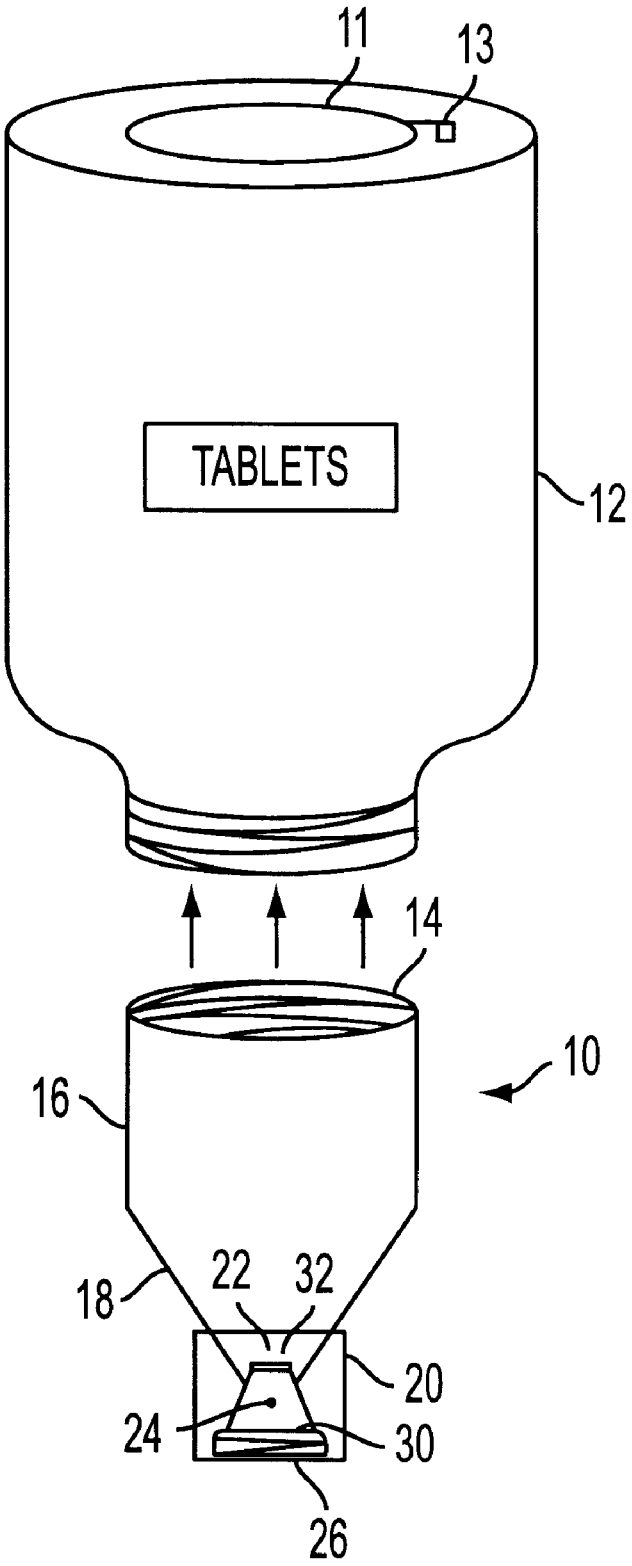
FIG. 1A depicts a dispensing device according to an embodiment of the present invention.

FIG. 1A depicts one embodiment of a dispensing device and a container according to the present invention. In one embodiment, container 12 may be provided with an opening in the bottom. A plug 11 may be used to plug the hole and a locking mechanism 13 may be provided to secure plug 11 on container 12. In one embodiment, plug 11 may be a rubber stopper device.

Figure 1B:
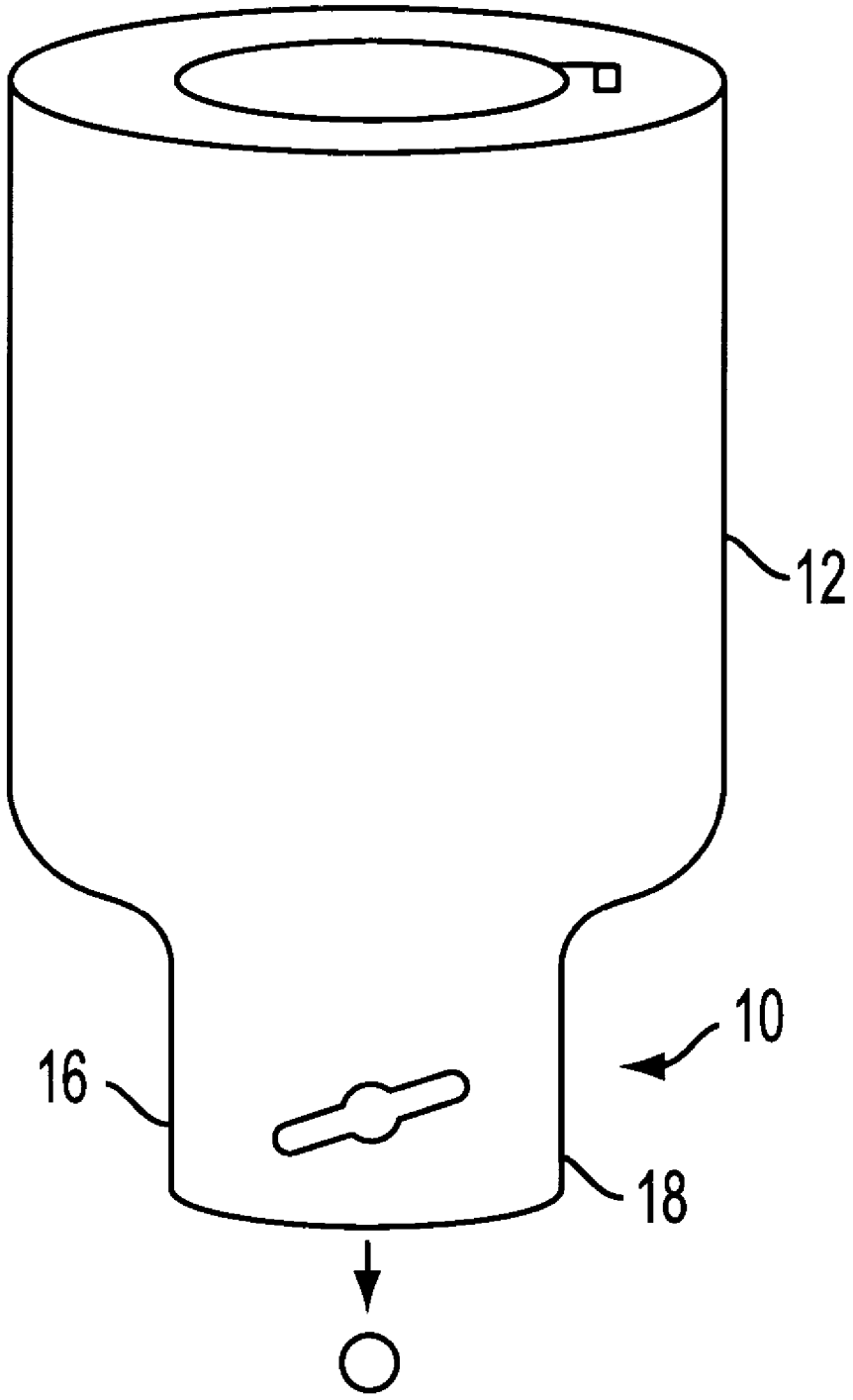
FIG. 1B depicts a combined container and dispensing device according to an embodiment of the present invention.

Dispensing device 10 may be attachable to container 12. Alternatively, as shown in FIG. 1B, dispensing device 10 may comprise a portion of container 12. All of the features discussed with respect to FIG. 1A may also be provided in the embodiment of FIG. 1B. Dispensing device 10 comprises a top portion 14, a body portion 16, a funneling portion 18, and a dispensing portion 20. The exterior of top portion 14, body portion 16, and funneling portion 18 form a housing. An opening is formed in top portion 14 of the housing of dispensing device 10.

Body portion 16 joins top portion 14 and funneling portion 18 and may comprise a generally conically shaped structure. Preferably, body portion 16 may be selected to be slightly larger than the top of the largest container for which dispensing device 10 is intended to be used. For example, if dispensing device 10 is intended to be used for containers having a diameter of 6 inches, then body portion 16 should have a diameter of about 6⅛". Those of skill in the art will recognize the appropriate sizing of body portion 16 with respect to the largest container to be used with dispensing device 10.

The interior of funneling portion 18 is preferably gradually sloped from body portion 16 to dispensing portion 20 to direct the contents of the container from body portion 16 to dispensing portion 20.

Dispensing portion 20 may comprise an adjustable opening 22, an adjustment control mechanism 24, and a receiving tray 26. Adjustable opening 22 may be positioned at the junction of dispensing portion 20 and funneling portion 18 such that the contents of the dispensing mechanism are positioned directly over adjustable opening 22. Adjustable opening 22 may therefore be positioned in the bottom of the housing of dispensing device 10. Adjustment control mechanism 24 may be positioned on the exterior surface of dispensing portion 20 to allow a user access to it. Receiving tray 26 is positioned at the bottom of dispensing portion 20 and is positioned directly below adjustable opening 22.

Figure 2A:
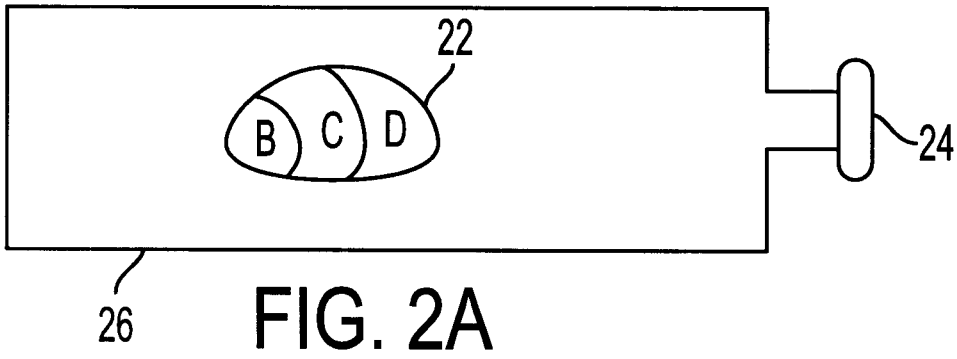
FIG. 2(*a*) depicts an overhead view of a dispensing mechanism according to an embodiment of the present invention.
Figure 2B:
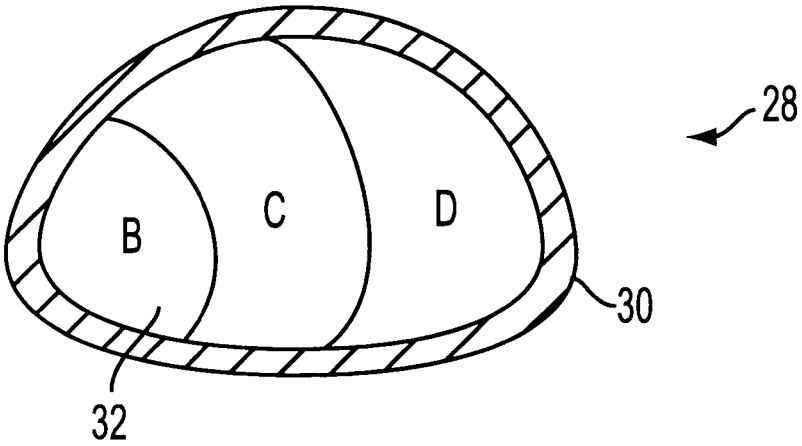

FIG. 2 depicts an overhead view of an adjustable opening 22 and adjustment control mechanism 24. In one embodiment of the present invention, adjustable opening 22 comprises a retractable mechanism and adjustable control mechanism 24 comprises a knob. Adjustable control mechanism 24 may comprise a push/pull mechanism, a rotating knob, or a button which electro-mechanically actuates adjustable opening 22.

Figure 3:
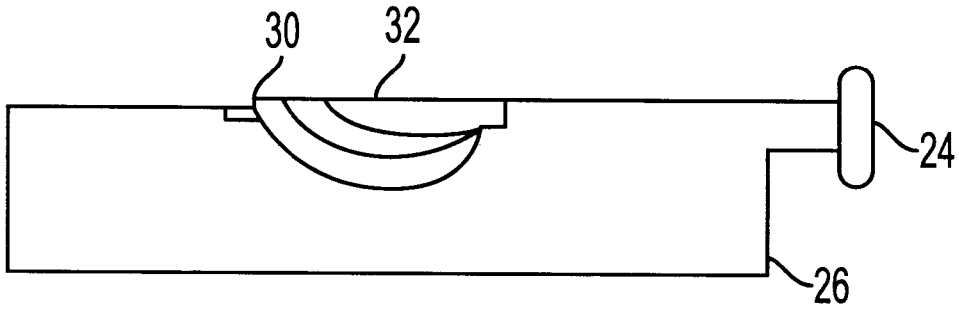
FIG. 3 depicts a side view of a dispensing mechanism according to an embodiment of the present invention.
Figures 4A, 4B, 4C:
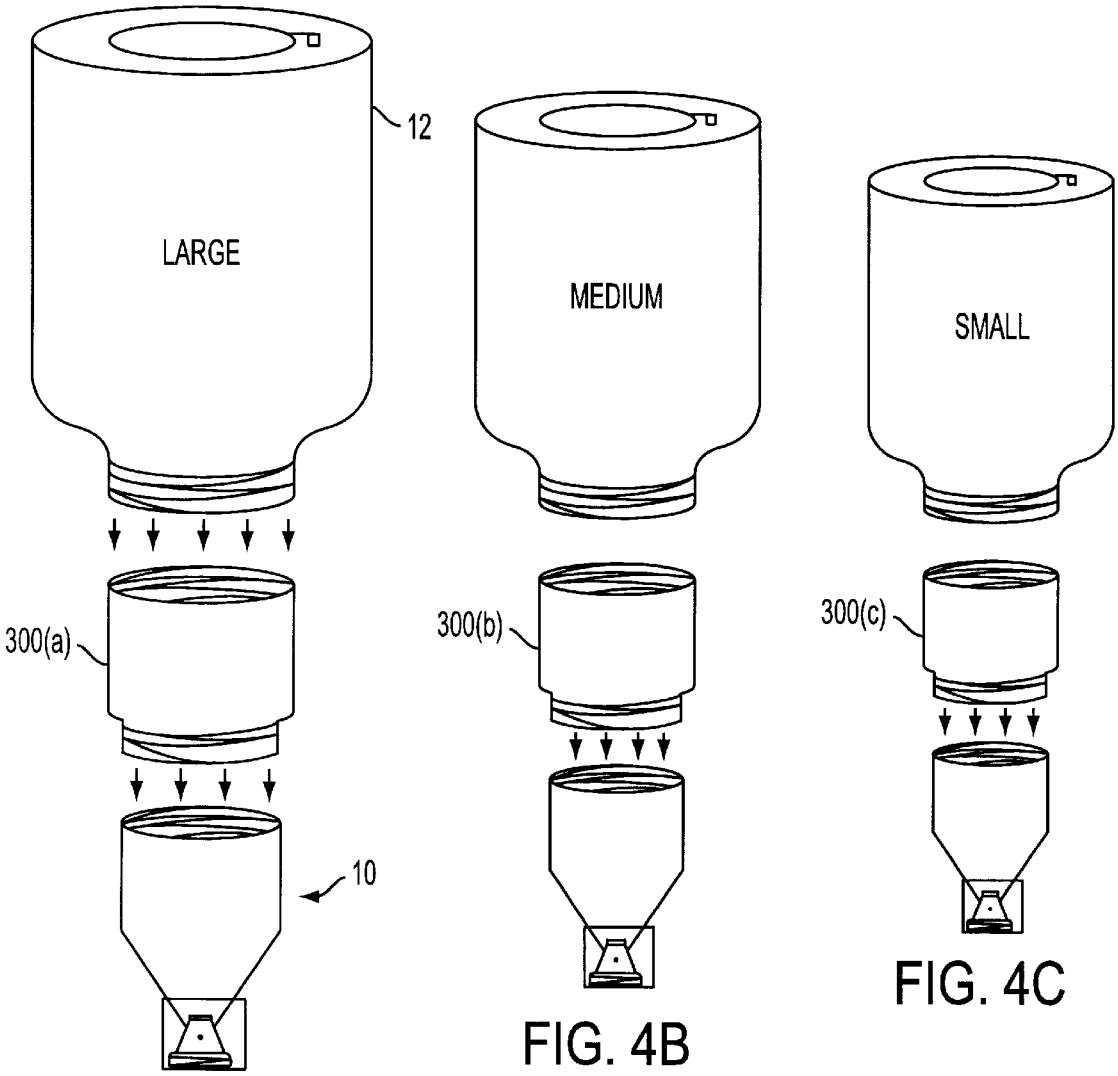
FIGS. 4(*a*)–(*c*) depict various attachment mechanisms according to embodiments of the present invention.
Figure 4D:
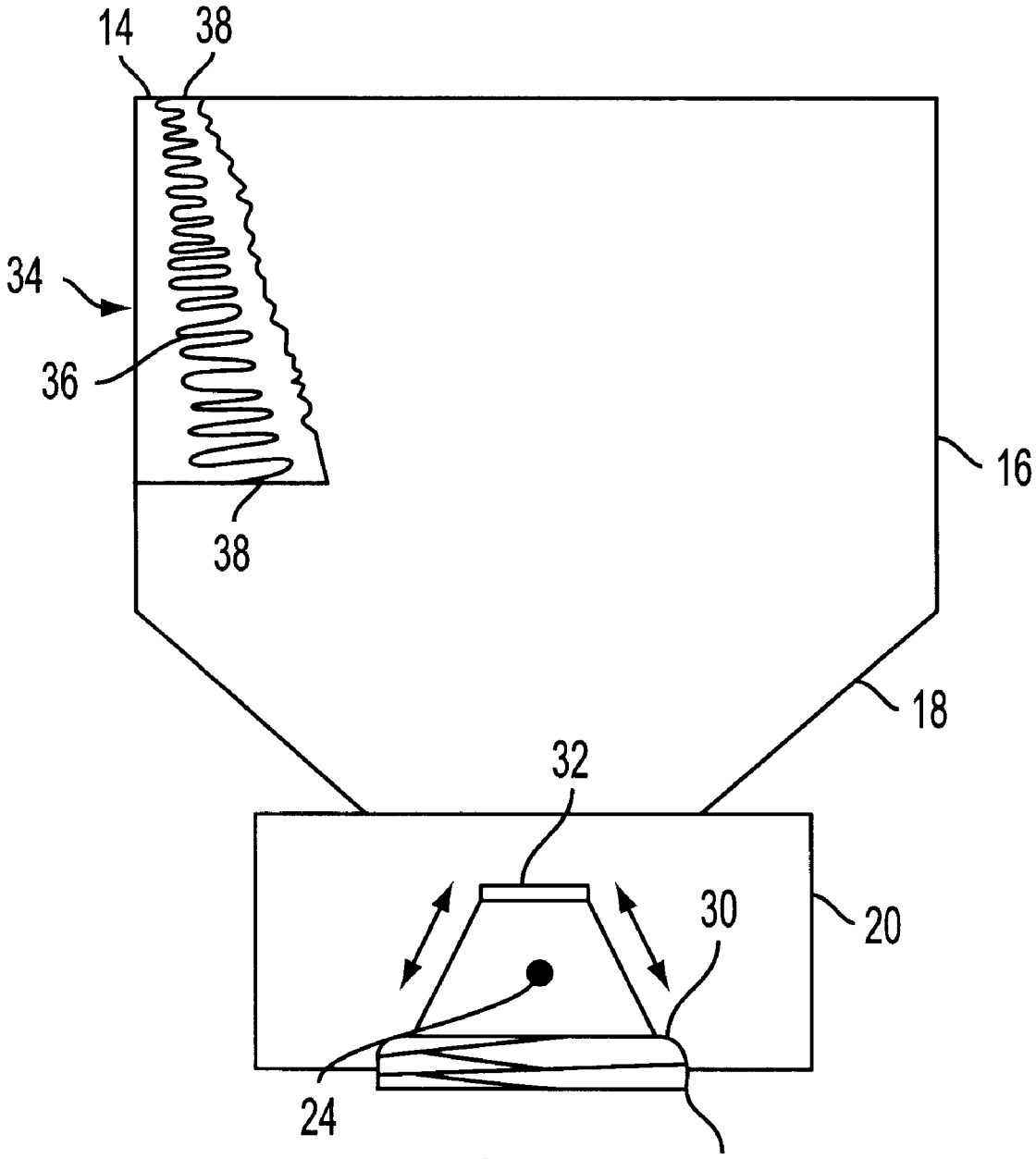
Figure 4E:
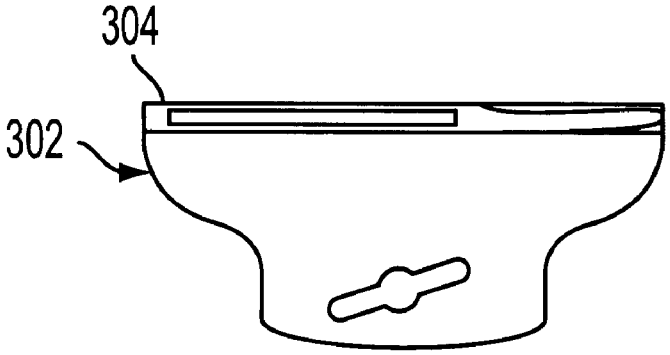
Figure 4F:
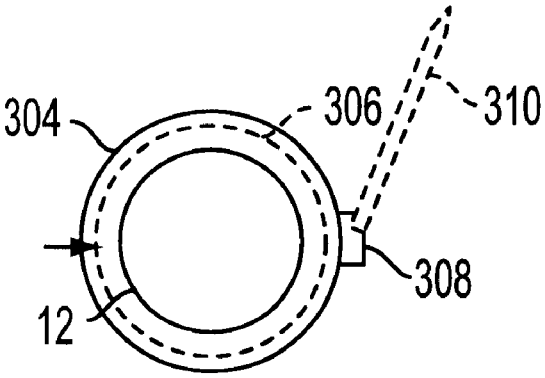
Figure 4G:
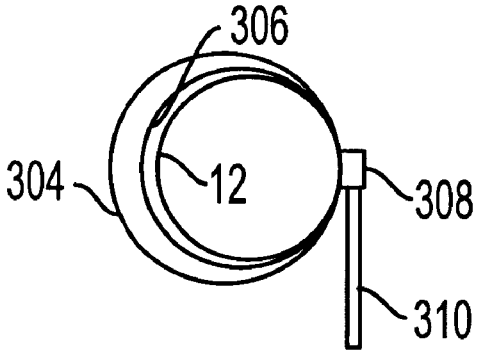

FIGS. 1–3 depict a retractable mechanism 28 according to an embodiment of the present invention. Retractable mechanism 28 may be conically shaped, with a larger opening 30 and a smaller opening 32 at opposite ends. Smaller opening 32 may be disposed at the junction of funneling portion 18 and dispensing portion 20. As retractable mechanism 28 is adjusted, smaller opening 32 opens wider and descends toward larger opening 30.

Also, adjustable opening 22 may comprise a flat, variable-size opening mechanism. Such a device may comprise a plurality of pieces that rotate toward and away from the center of the opening. The combination of the pieces covers the opening when they are all rotated toward the hole and creates an opening when they are rotated away from the center of the opening. Other adjustable opening mechanisms may also be used.

Dispensing device 10 may also comprise an attachment mechanism 34 at top portion 14. According to one embodiment, attachment mechanism 34 may comprise threading such that dispensing device 10 screws onto container 12.

According to another embodiment of the present invention, disposing device 10 may be connected to different sized containers by use of adapters 300(*a*)–300(*c*). Adapters 300 may be provided in a number of different sizes to enable a single sized disposing device to be connected to different sized containers.

According to another embodiment of the present invention, attachment mechanism 34 may be adjustable to accommodate multiple sizes of containers. FIG. 4(*d*) depicts an adjustable attachment mechanism 34. In one embodiment, adjustable attachment mechanism 34 may comprise a stepped finned structure 36.

Stepped finned structure 36 comprises a plurality of fins 38 circumferentially disposed about the interior of top portion 14 of dispensing portion 10. Each fin 38 extends radially toward the center of dispensing mechanism 10. Each fin 38 forms a ring around the interior of dispensing mechanism 10. The diameter of each fin 38 decreases from the top of dispensing mechanism 10 toward funneling portion 18 as, for example, depicted in FIG. 4.

Stepped finned structure 36 may be formed of a pliable substance such that it bends while maintaining some degree of rigidity. Rubber, for example, may be used, although other substances may also be used. Stepped fin structure 36 may then be attached to a container 12 by pressing disposing top 10 onto container 12. Fins 38 grab threading provided on container 12 to secure dispensing mechanism 10 to container 12.

By providing fins that decrease in diameter, different sizes of containers may be accommodated. Larger containers are grabbed by the fins disposed at the top of stepped fin structure 36 whereas smaller containers are grabbed at the smaller diameter fins. By using a pliable material, fins 38 bend over the threading on container 12 but are rigid enough to support the weight of disposing device 10 on the threads of container 12.

Another embodiment of an adjustable attachment mechanism 34 is depicted in FIGS. 4(*e*)–4(*g*).

FIG. 4(*e*) depicts an expandable tightening lever device 302. Device 302 comprises an outer shell 304 with a band 306 disposed in the interior of outer shell 304. The ends of band 306 attach to screw-lever device 308. Lever 310 attaches to one end of band 306 and the other end of band 306 is attached to screw lever device 308. As lever 310 is closed into the position, as depicted in FIG. 4(*g*), band 306 tightens, thus enabling dispensing device 10 to be attached to different sizes of containers. When released, as depicted in FIG. 4(*f*), band 306 relaxes and dispensing device 10 may be removed from container 12.

Other mechanisms for attaching disposing device 10 to container 12 may also be used as one of ordinary skill in the art would recognize. A stepped fin structure and expandable tightening device may also be used for differently shaped containers including square, triangular, etc. As such the stepped fin structure and top portion 14 of dispensing device 10 may have a corresponding shape to the container.

Dispensing device 10 operates as follows. Dispensing device 10 may be attached to a container 12 that contains some smaller food products such as vitamins, pills, or other tablet shaped foods. Container 12 may then be inverted so dispensing device 10 is positioned below container 12. Once inverted, the contents of container 12 fall through top portion 14 and accumulate in body portion 16 and funneling portion 18 of dispensing mechanism 10. The contents are positioned by funneling portion 18 directly over adjustable opening 22.

When a user desires to remove one of the contents, the user actuates adjustable control mechanism 24 which in turn gradually opens adjustable opening 22. When one of the contents falls through adjustable opening 22, the contents are caught by receiving tray 26 which may be disposed below adjustable opening 22. At that point, the user may close adjustable opening 22 using adjustable control mechanism 24. To retrieve the contents, the user may then place his or her hand under receiving tray 26 and slide receiving tray 26 open until the contents fall into the user's hand.

Figure 5:
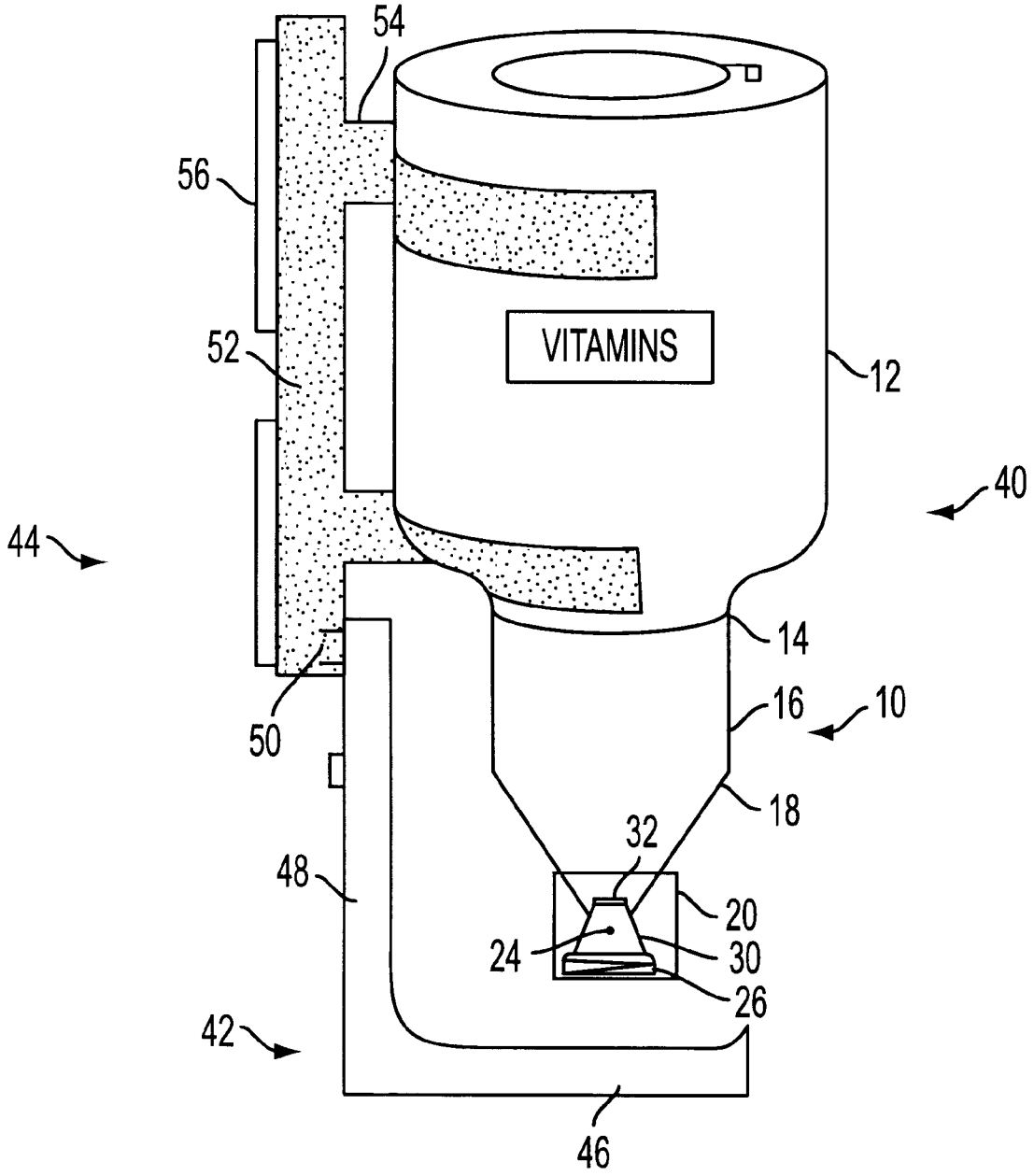
FIG. 5 depicts a dispensing system according to an embodiment of the present invention.
Figure 6:
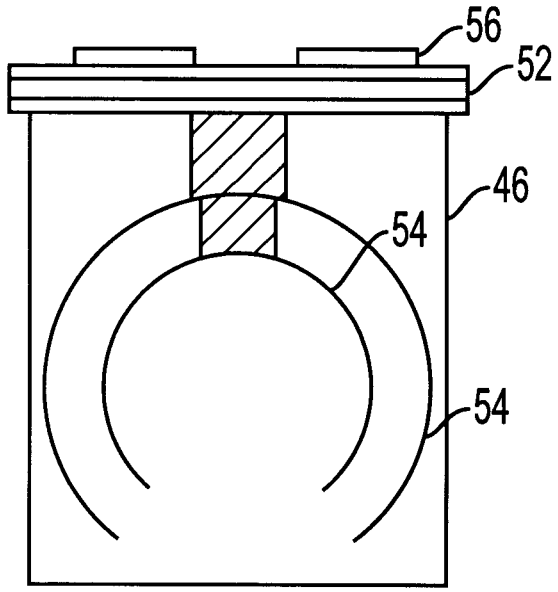
FIG. 6 depicts an overhead view of a dispensing system according to FIG. 5.

For convenience of the user, container 12 and dispensing device 10 may be placed in a holding assembly. An embodiment of a holding assembly 40 is depicted in FIGS. 5 and 6. Holding assembly 40 may comprise a base portion 42 and a side portion 44. Base portion 42 may comprise a foot portion 46, a stand portion 48, and a connection mechanism 50.

Side portion 44 may comprise a wall portion 52, one or more arm portions 54, and a wall attachment portion 56. Base portion 42 and side portion 44 may be connected by connection mechanism 50. Connection mechanism 50 may comprise screws, snap-in connectors, glue, or any other type of connection device.

Base portion 42 may be used to support the holding assembly such that the entire dispensing system (holding assembly 40, container 12, and dispensing device 10) may be placed on a table or other flat surface. Alternatively, holding assembly 40 may be affixed to a wall using wall attachment portion 56. Wall attachment portion 56 may comprise two-sided tape, screws, nails, or other wall attachment devices. Other methods of attaching holding assembly 40 to a wall may also be used.

Base portion 40 may also serve to catch any contents from container 12 that the user may miss. Foot portion 46 may thus be shaped so as to catch the falling contents from receiving tray 26.

As seen in FIG. 6, arm portion 54 may be semi-circular to receive container 12. In the embodiment of FIGS. 5 and 6, two different sized arm portions may be provided to receive container 12. More than two arms portions may also be provided. Also, arm portions may be the same size.

Figure 8:
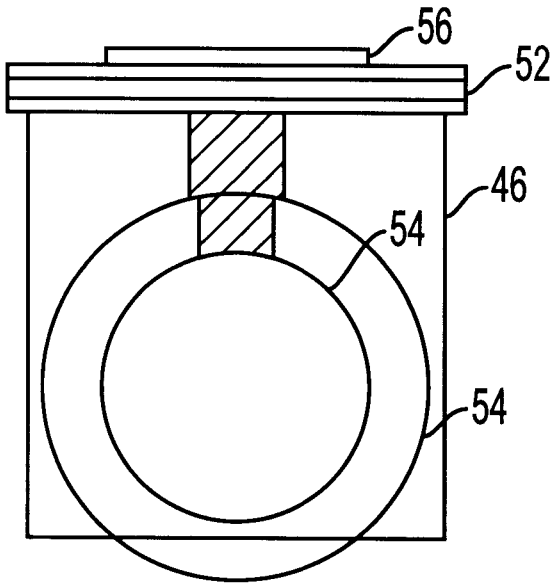
FIG. 8 depicts an overhead view of a dispensing system according to FIG. 7.
Figure 7:
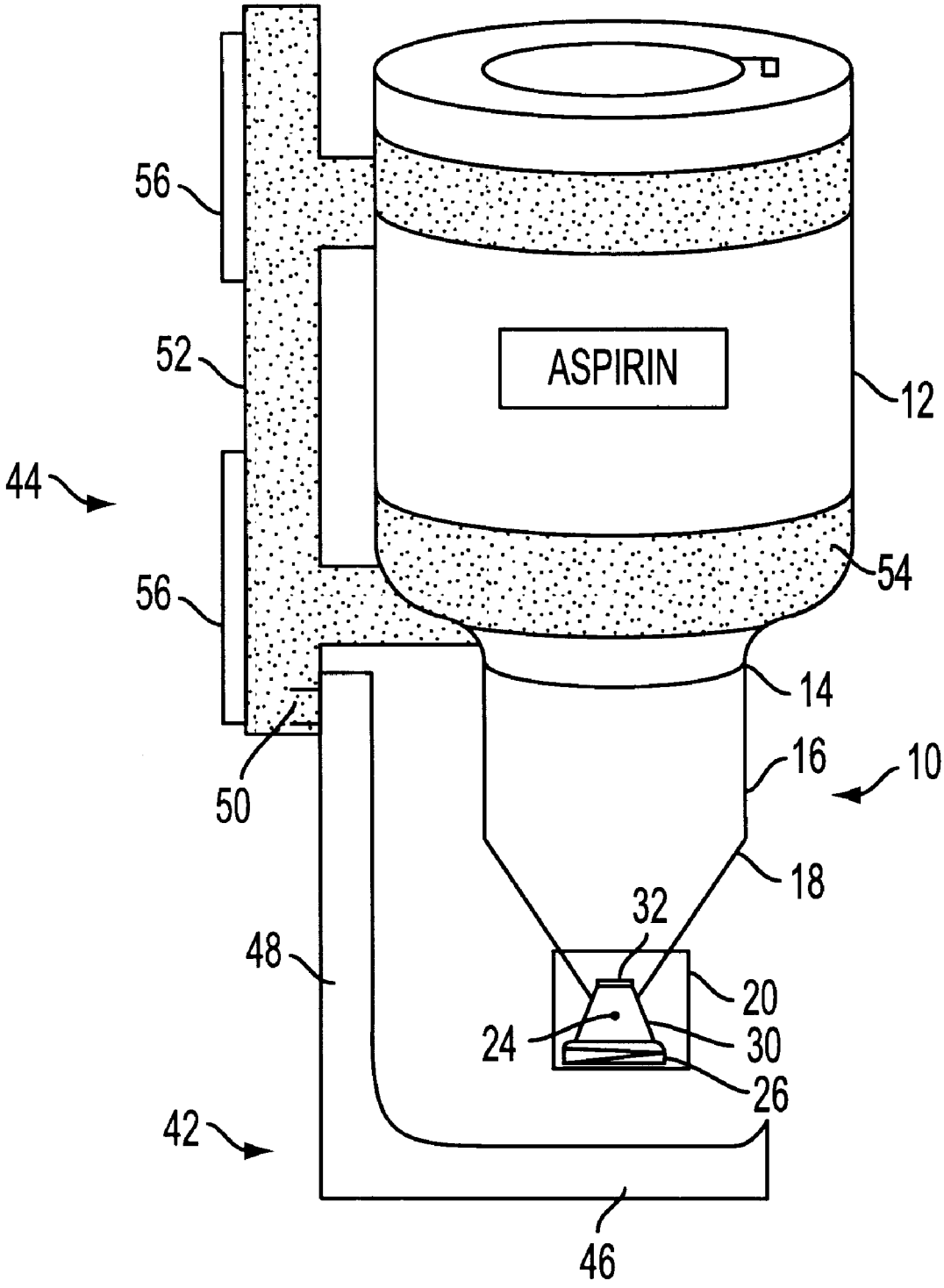
FIG. 7 depicts a dispensing system according to another embodiment of the present invention.

In another embodiment of the present invention, as shown, for example, in FIGS. 7 and 8, arm portions 54 may be completely circular. Other shapes and sizes of arm portions 54 may also be used to receive container 12. For example, square, triangular, hexagonal, and pentagon shapes may be provided to receive different shapes of containers.

Another embodiment may include providing the bottom of dispensing portion 20 as being flat to enable the device to be placed on a table without additional support.

Figure 12A:
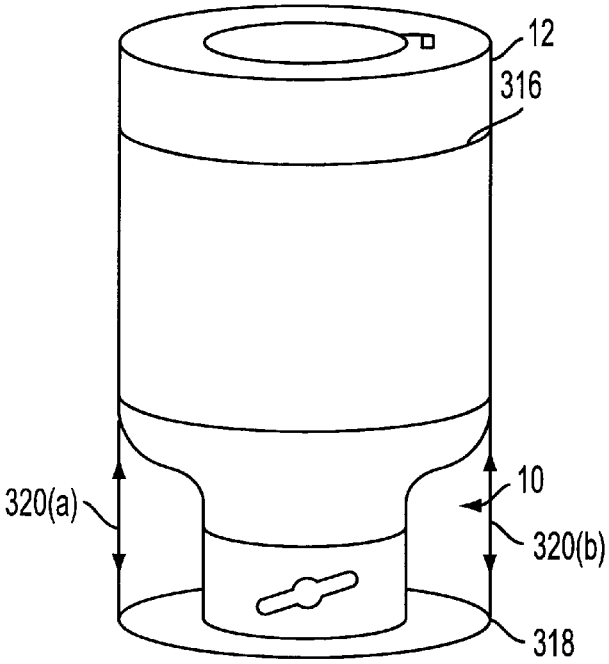
FIG. 12(*a*) depicts a support structure according to an embodiment of the present invention.
Figure 12B:
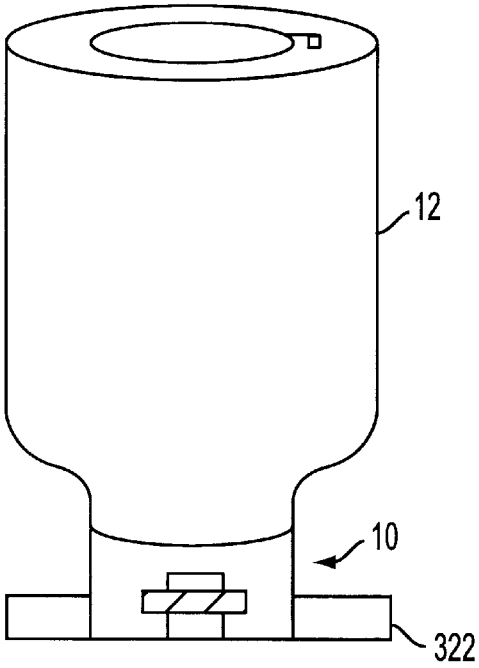
Figure 12C:
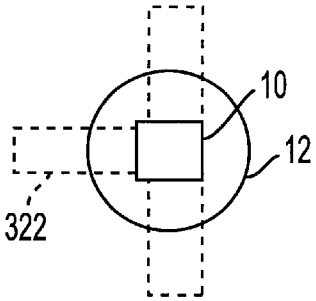
Figure 13A:
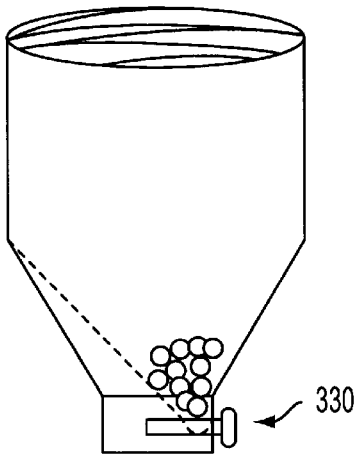
FIGS. 13(*a*)–(*b*) depict a dispensing mechanism according to another embodiment of the present invention.
Figure 13B:
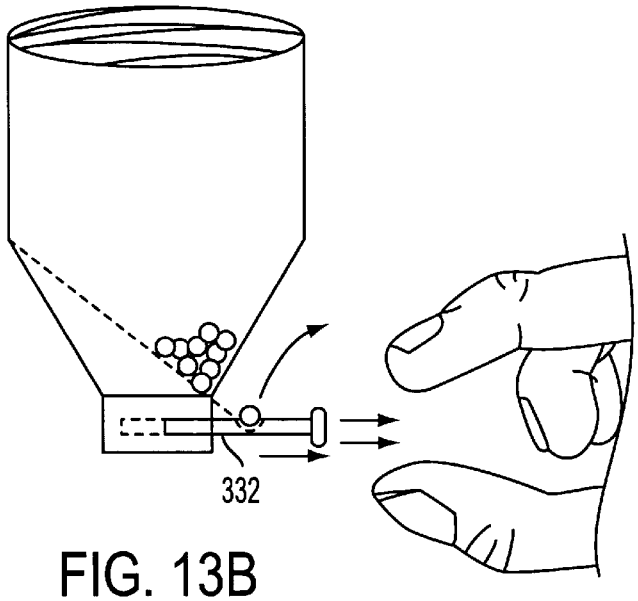

Also, FIGS. 13(*a*)–(*c*) depict embodiments of support structures for the device. In FIG. 12(*a*), a dual ringed structure may be provided. Top ring 316 and bottom ring 318 may be connected by adjustable posts 320(*a*) and (*b*).

FIGS. 13(*b*) and (*c*) depict an embodiment for supporting the dispensing device 10 and container 12 by providing dispensing device 10 with legs 322 which may extend from dispensing device 10 to support the structure.

Figure 9:
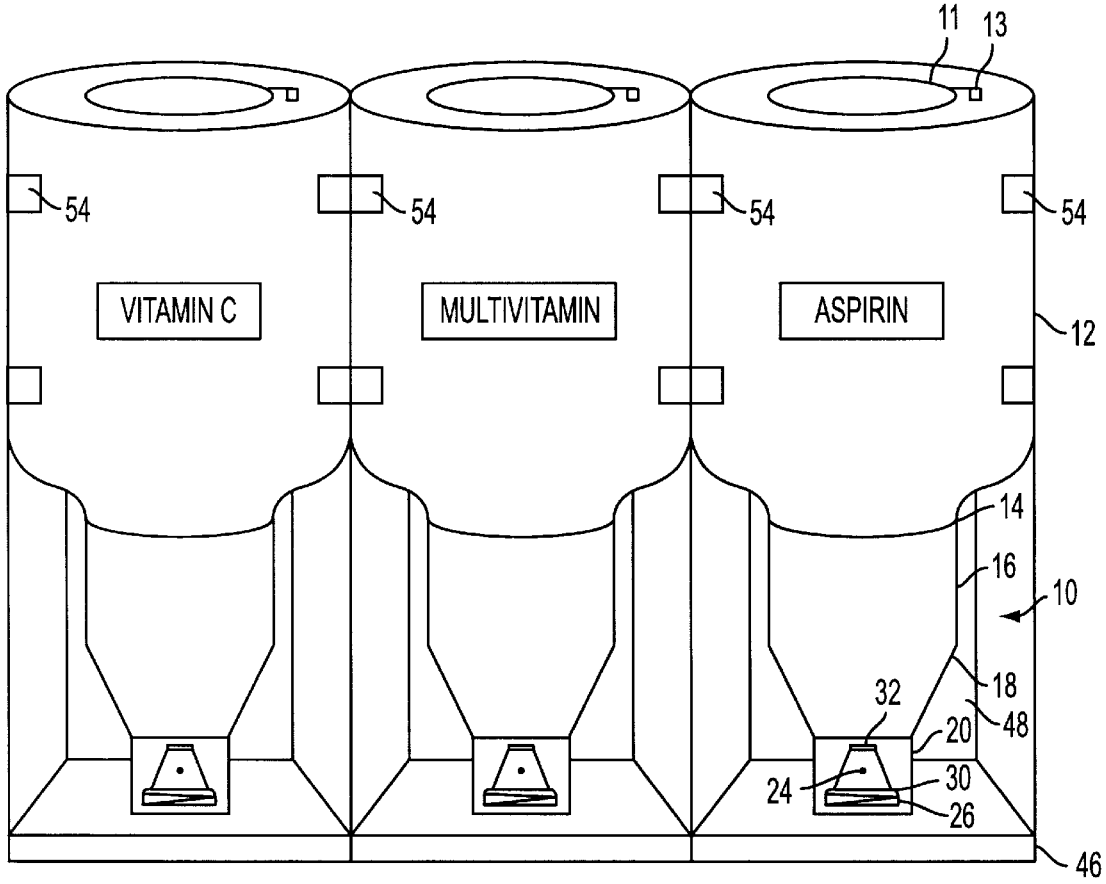
FIG. 9 depicts a dispensing system according to yet another embodiment of the present invention.

Because a user may be taking a variety of different medications or may take a large number of different vitamins, a multi-pack dispensing assembly may be provided according to the present invention. FIG. 9 depicts a multiple dispensing assembly according to one embodiment of the present invention. As depicted in FIG. 9, multiple holding assemblies 40 may be attached together. Holding assemblies 40 may be attached using glue, screws, double-sided tape, sliding engagement, or another attachment mechanism. Additionally, the multiple dispensing assembly may be integrally formed, for example, by forming the entire structure from plastic using a plastic molding technique. Further, although three holding assemblies are depicted in FIG. 9 as being together, two or more may be used, for as many different holding assemblies as a particular person may desire.

Figure 10:
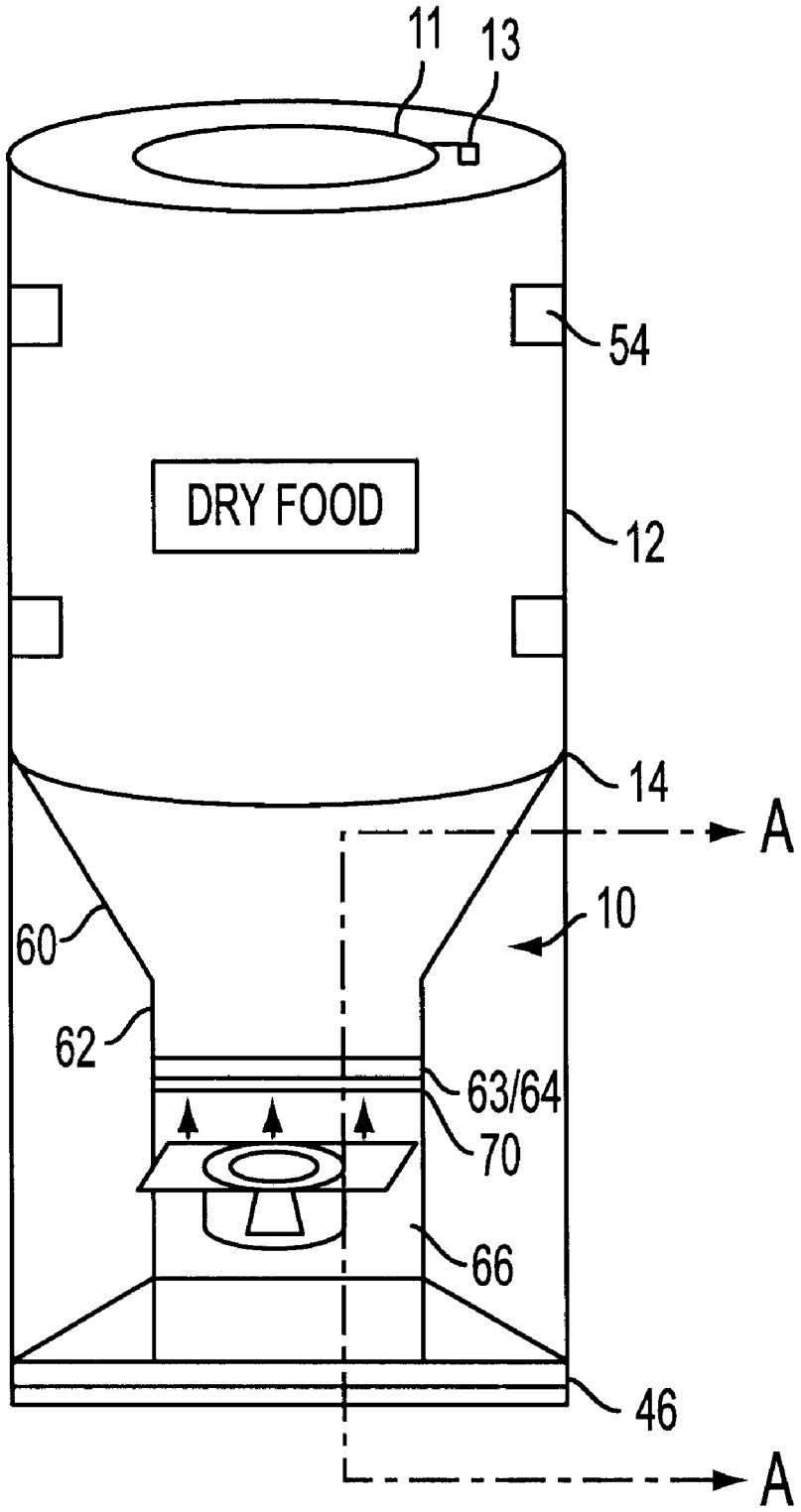
FIG. 10 depicts a dispensing mechanism according to yet another embodiment of the present invention.
Figure 11:
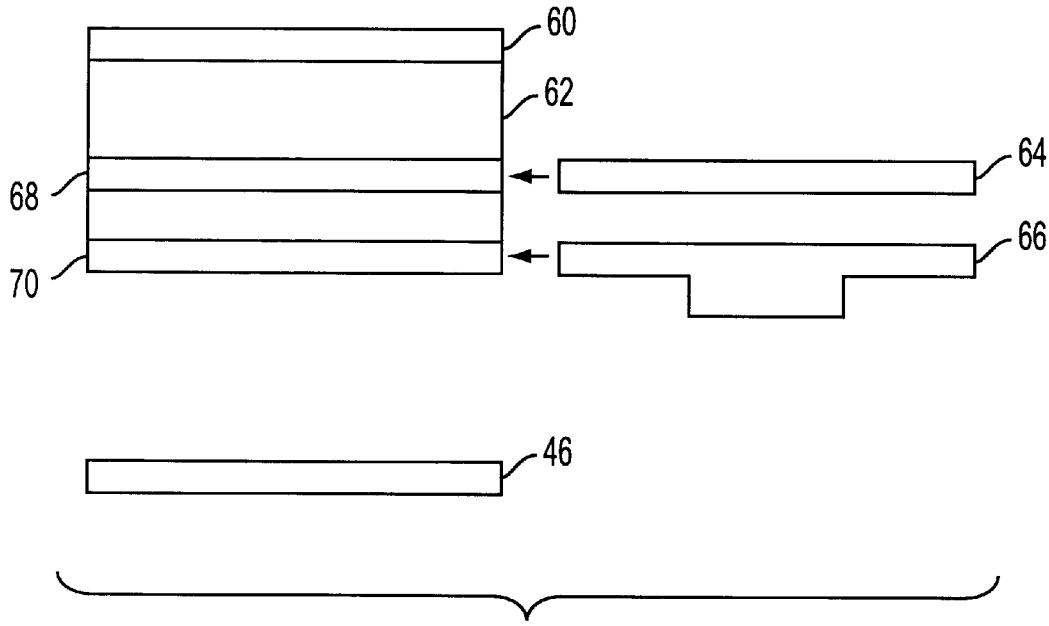
FIG. 11 depicts the dispensing mechanism of FIG. 10 taken along line A—A.

According to another embodiment of the present invention, it may be desirable to dispense the contents of a container by volume rather than by count. Accordingly, FIGS. 10 and 11 depict a volumetric dispensing assembly according to an embodiment of the present invention.

According to this embodiment, dispensing device 10 comprises a top portion 14, a funneling portion 60, a bottom portion 62, a leveling portion 64, and a receiving portion 66. Funneling portion 60 directs the contents into bottom portion 62. A leveling slot 68 and a receiving slot 70 may be disposed in bottom portion 62 to receive leveling portion 64 and receiving portion 68.

To dispense contents in this embodiment, the user pulls out leveling portion 64. The contents then fall into receiving portion 66. The user then pushes leveling portion 64 back into its original position to level off the contents of receiving portion 66. The user then may remove receiving portion 66 and place the contents as desired. In this embodiment, multiple different sizes of receiving portions 66 may slide into the same slot in dispensing mechanism 10. FIG. 12 depicts a number of different receiving portions that may be used in the same slot size in dispensing mechanism 10.

Other mechanisms for dispensing tablets may also be provided in any of the embodiments disclosed above.

Figure 14A:
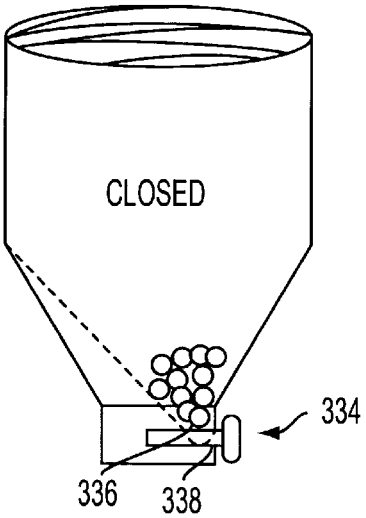
FIGS. 14(*a*)–(*b*) depict a dispensing mechanism according to another embodiment of the present invention.
Figure 14B:
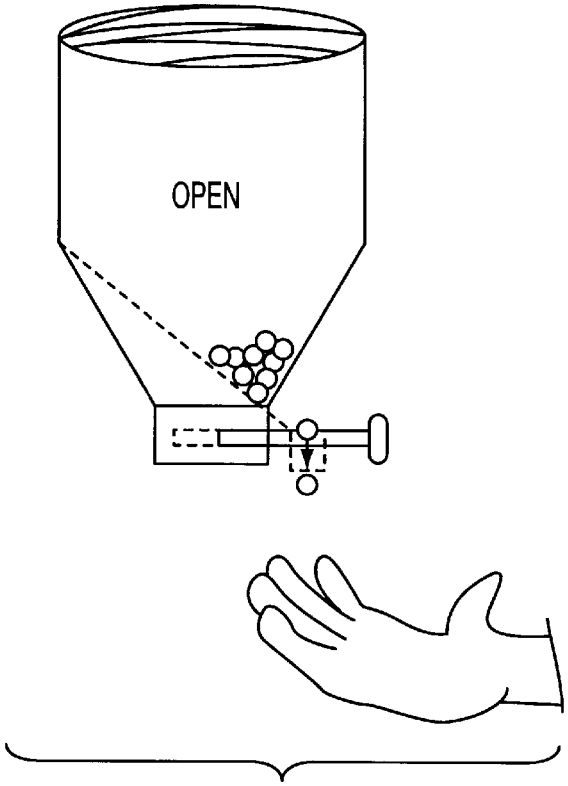

FIGS. 14(*a*) and (*b*) depict a dispensing portion 20 with a pull-type receiving tray 330 with an opening 332 to receive a pill. As in the other embodiments, the size of opening 332 may be adjustable. In this embodiment, opening receives a pill and may be pulled out to retrieve it.

Figure 15A:
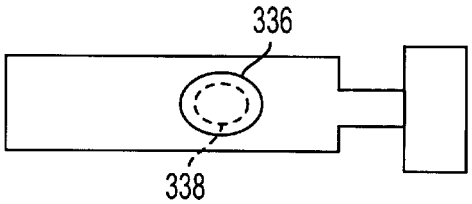
FIGS. 15(*a*)–(*b*) depict a portion of a dispensing mechanism according to an embodiment of the present invention.
Figure 15B:
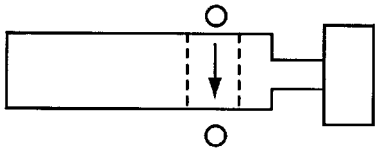

FIGS. 15(*a*)–(*d*) depict various views of another pull-type receiving mechanism 334 with a receiving opening 336 to receive the pill and a bottom opening 338 to allow the pill to drop into a user's hand. FIG. 15(*c*) depicts an overhead view and FIG. (*d*) depicts a side view of the slide portion of the pull type receiving mechanism 334. A guide 340 may also be provided to guide the pill.

Figure 16A:
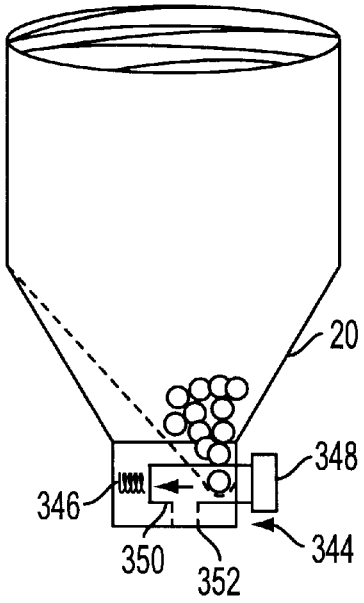
FIGS. 16(*a*)–(*b*) depict a dispensing mechanism according to another embodiment of the present invention.
Figure 16B:
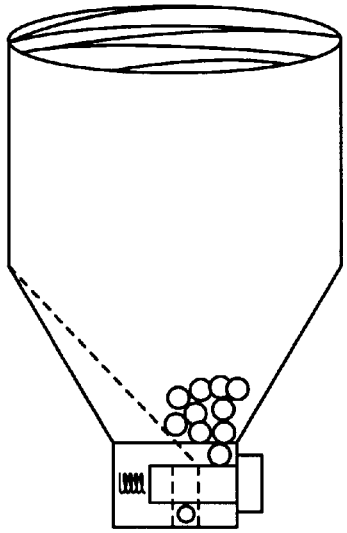
Figure 17A:
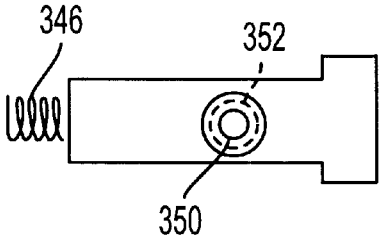
FIGS. 17(*a*)–(*e*) depict a portion of a dispensing mechanism according to an embodiment of the present invention.
Figure 17B:
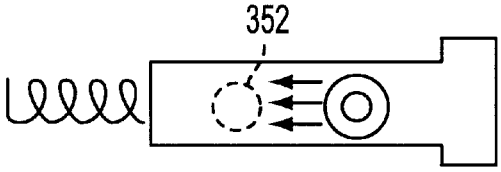
Figure 17C:
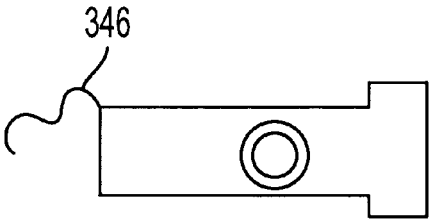
Figure 17D:
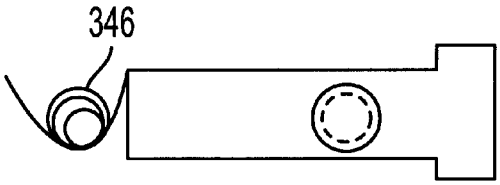
Figure 17E:
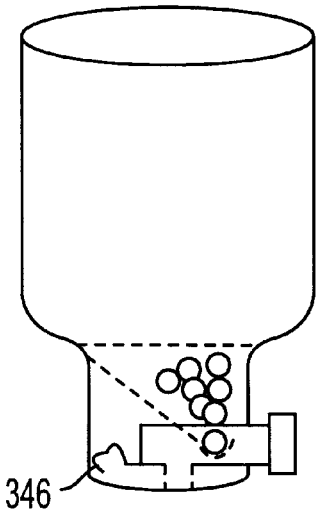
Figure 17F:
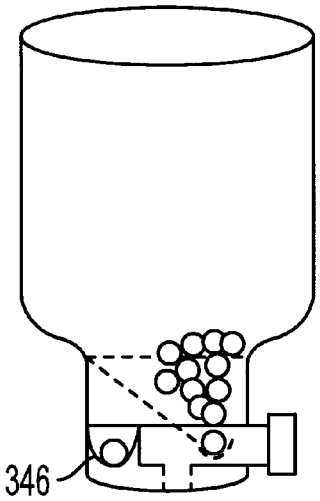

FIGS. 16 and 17 depict another dispensing portion 20. In the embodiment, a spring-loaded push mechanism 344 is provided. Mechanism 344 comprises a spring device 346 that resists movement of slide 348. Slide 348 has an opening 350 therein. The bottom portion of dispensing portion 20 also has an opening 352 therein such that when slide 348 is depressed by a user, as in FIG. 16(*b*), opening 350 aligns with opening 352 to permit a pill to drop therethrough. As depicted in FIGS. 17(*a*), 17(*c*) and 17(*d*), spring device 346 may comprise a coiled spring, a flexible device made of, for example, plastic, or a hinged spring. Other spring like components may be used to provide some resistance during operation.

Figure 18A:
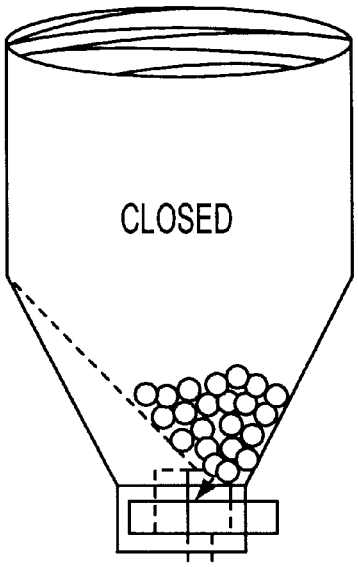
FIGS. 18(*a*)–(*b*) depict a dispensing mechanism according to another embodiment of the present invention.
Figure 18B:
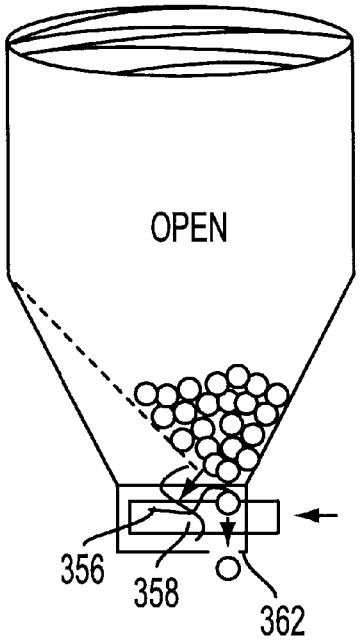
Figure 19:
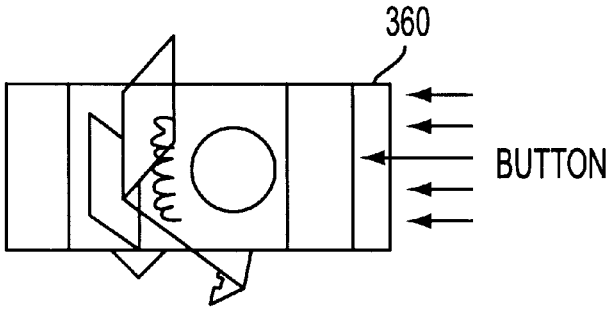
FIG. 19 depict a portion of a dispensing mechanism according to an embodiment of the present invention.
Figure 20A:
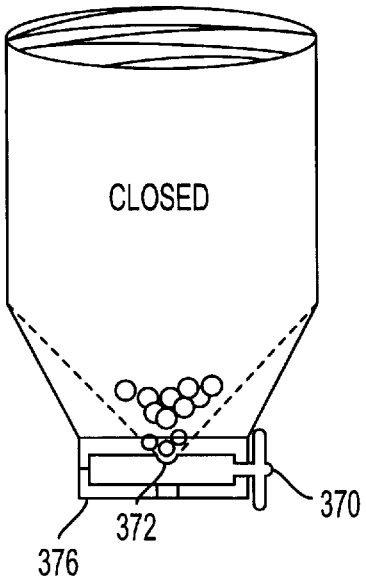
FIGS. 20(*a*)–(*c*) depict a dispensing mechanism according to another embodiment of the present invention.
Figure 20B:
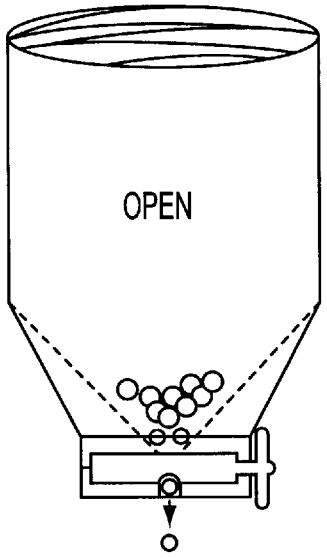
Figure 20C:
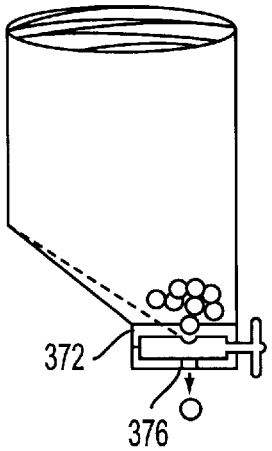
Figure 20D:
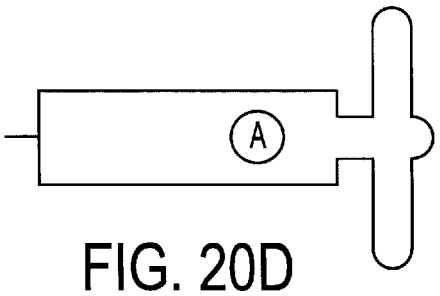
Figure 20E:
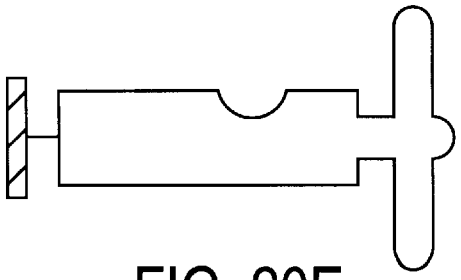

FIGS. 18 and 19 depict another dispensing portion 20 with a rotating mechanism 354. Mechanism 354 comprises a plurality of teeth 356 connected to a central axle 358. When button 360 is depressed, mechanism 354 rotates and a tooth 356 grabs a pill and forces it down through opening 362 in dispensing portion 20 according to various known methods for rotating teeth-like structures around an axle.

FIG. 20 depicts another dispensing portion 20 which comprises a rotating mechanism 370 with an opening 372 therein. The mechanism 370 may be rotated to permit a pill to drop into rotating portion 374 and, when further rotated, drop the pill through opening 376 to a user. In this, and other embodiments, the portion of the mechanism may be formed of air sealing components such as rubber and the like.

Figure 21A:
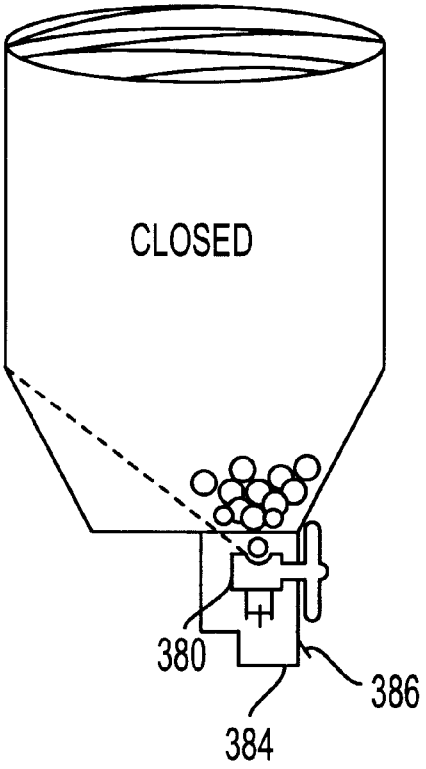
FIGS. 21 (*a*)–(*b*) and 22(*a*)–(*b*) depict a dispensing mechanism according to another embodiment of the present invention.
Figure 21B:
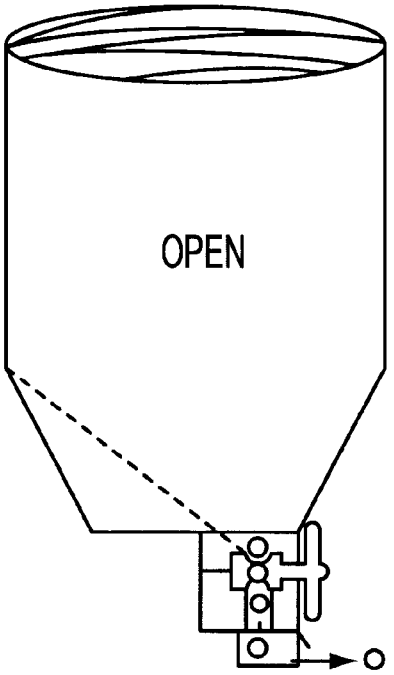
Figure 22A:
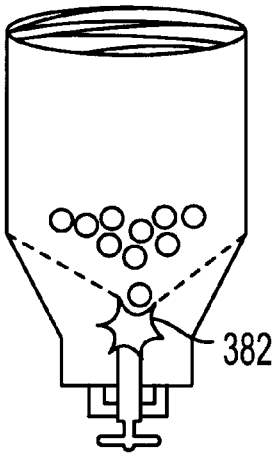
Figure 22B:
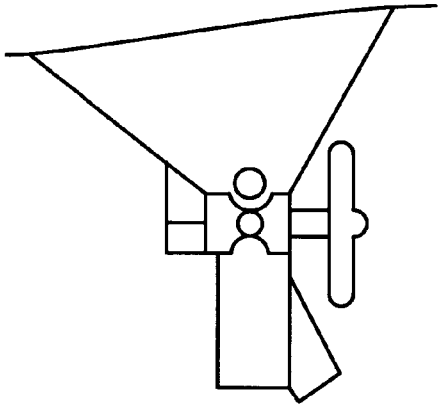

FIGS. 21 and 22 depict another embodiment with another rotating mechanism 380 having a plurality of openings 382. Also, in this and other embodiments, a shoot 384 may be provided to permit the user to retrieve the pill. Shoot 384 may be provided with a cover 386 as well.

Other embodiments and uses of the invention will be apparent to those skilled in the art from consideration of the specification and practice of the invention disclosed herein. The specification and examples should be considered exemplary only. The intended scope of the invention is only limited by the claims appended hereto.

What is claimed is:

1. A dispensing device for use with a container for storing a plurality of items, the container having an opening formed in one end to form a container neck, the dispensing device comprising:

a housing having an cylindrically-shaped open portion and a cylindrically-shaped dispensing portion;

adjustable affixing means, disposed within the cylindrically-shaped open portion, for affixing the open portion of the housing to a container opening having an outer circumference, wherein the adjustable affixing means adjusts to accommodate containers having different shapes and sizes by connecting the cylindrically shaped open portion to the exterior of the container opening to prevent exposure of the contents of the container when the container is inverted;

wherein the adjustable affixing means en,ages an outer circumference of the container neck to form sealing contact with the outer circumference;

a rotating mechanism disposed in the dispensing portion wherein the rotating mechanism comprises an opening that receives a single item from the container; and wherein the rotating mechanism may be rotated so the opening in the rotating mechanism aligns with an aperture in the dispensing portion to thereby release the single item from the dispensing portion through the aperture in the dispensing portion.

2. The dispensing device of claim 1 wherein the means for affixing comprises threading which interfaces with threading on the exterior of the container.

3. The dispensing device of claim 1 wherein the means for affixing comprises a stepped fin mechanism which attaches the dispensing device to the exterior of different sized containers.

4. A dispensing system comprising:

one or more containers for holding a plurality of items, the container having an opening formed in one end to form a container neck; and one or more dispensing devices, each comprising:

a housing having an cylindrically-shaped open portion and a cylindrically-shaped dispensing portion;

adjustable affixing means, disposed within the cylindrically-shaped open portion, for affixing the open portion of the housing to a container opening, wherein the adjustable affixing means adjusts to accommodate containers having different shapes and sizes by connecting the cylindrically shaped open portion to the exterior of the container opening to prevent exposure of the contents of the container when the container is inverted;

wherein the adjustable affixing means engages an outer circumference of the container neck to form sealing contact with the outer circumference;

a rotating mechanism disposed in the dispensing portion wherein the rotating mechanism comprises an opening that receives a single item from the container; and wherein the rotating mechanism may be rotated so the opening in the rotating mechanism aligns with an aperture in the dispensing portion to thereby release the single item from the dispensing portion through the aperture in the dispensing portion.

5. The dispensing system of claim 4 further comprising:

one or more holding assemblies for supporting at least one container and at least one dispensing device, each holding assembly comprising:

a base portion; and a plurality of supporting portions, connected to the base portion, for receiving and supporting at each container.

6. The dispensing system of claim 5 comprising a plurality of holding assemblies connected together, each holding assembly receiving and supporting at least one container and each container being connected to a dispensing device.

7. The dispensing device of claim 4 wherein the means for affixing comprises threading which interfaces with threading on the exterior of the container.

8. The dispensing device of claim 4 wherein the means for affixing comprises a stepped fin mechanism which attaches the dispensing device to the exterior of different sized containers.

* * * * *